United States Patent [19]

Dew et al.

[11] 3,977,843

[45] Aug. 31, 1976

[54] PURIFICATION PROCESS FOR COAL GAS METHANATION

[75] Inventors: John N. Dew; Burton M. Casad; Eugene A. Harlacher, all of Ponca City, Okla.; Joseph A. Kleinpeter, McMurray, Pa.

[73] Assignee: Continental Oil Company, Ponca City, Okla.

[22] Filed: Dec. 5, 1975

[21] Appl. No.: 637,918

[52] U.S. Cl. ..... 48/197 R; 48/210; 260/449 M

[51] Int. Cl.[2] ..... C10K 1/00

[58] Field of Search ..... 48/197 R, 202, 206, 48/210; 260/449 M; 423/242, 244, 564

[56] References Cited

UNITED STATES PATENTS

| | | | |
|---|---|---|---|
| 3,551,124 | 12/1970 | Iwaki et al. | 48/197 R |
| 3,625,664 | 12/1971 | Padovani | 260/449 M |
| 3,901,667 | 8/1975 | Herrmann | 48/197 R |

*Primary Examiner*—Robert L. Lindsay, Jr.
*Assistant Examiner*—George C. Yeung
*Attorney, Agent, or Firm*—Cortlan R. Schupbach, Jr.

[57] ABSTRACT

An improved method for removing sulfur compounds during coal gas methanation comprising removing essentially all carbon dioxide and hydrogen sulfide from synthesis gas, then adding carbon dioxide containing lower levels of sulfur back to the gas stream before feeding the mixture to a desulfurization reactor. Carbon dioxide, at levels above about 12 percent, will prevent high temperature methanation runaways in the hydrodesulfurization reactor, where a stream consisting essentially of hydrogen sulfide and methanation materials is produced, the lower level of hydrogen sulfide produced being removed by conventional methods before proceeding to methanation units. The carbon dioxide can be supplied either from an outside source or can be obtained from the synthetic natural gas after methanation.

4 Claims, No Drawings

PURIFICATION PROCESS FOR COAL GAS METHANATION

This invention relates to a process for purifying coal gasification products prior to hdyrodesulfurization. More particularly, this process relates to a method for removing essentially all carbon dioxide and sulfur from the coal gasification stream, then adding purified carbon dioxide back into the stream prior to hydrodesulfurization in order to prevent high temperature methanation runaways under low sulfur catalyst conditions in hydrodesulfurization reactors.

Hydrocarbons of a predominantly aliphatic nature, both paraffinic and olefinic, have generally been obtained from distillation and separation of crude petroleum and natural gas and from cracking of petroleum fractions. With the decline of available reserves of crude petroleum and natural gas, there is a great need for producing such hydrocarbons from sources which are not dependent on natural gas and petroleum feedstocks. Natural gas in particular is a readily desirable product because of its inherent clean burning properties.

The primary source of nonpetroleum hydrocarbons has been from the distillation of carbonaceous solids such as coal. Normally, these hydrocarbons are highly aromatic and constitute only a minor percentage of the initial charge of solids. Gasification of coal in the presence of oxygen and water to produce a gaseous stream is well known in the art.

Typically, coal gasification processes producing high quality synthetic natural gas involve processing coal by crushing to a small size, then gasifying the coal with water and oxygen at high temperatures to produce a gas rich in hydrogen, carbon monoxide, carbon dioxide, methane, and containing sulfur. Before methanating carbon monoxide and carbon dioxide to produce the synthetic natural gas, sulfur must be removed, since sulfur is a strong accumulative poison for methanantion catalysts. To maintain a reasonable catalyst life and high activity, the sulfur content must generally be reduced to less than 0.2 parts per million. Most of the sulfur in the gasification stream will be present as hydrogen sulfide, carbonyl sulfide, and carbon disulfide, but many forms of organic sulfide, such as mercaptans and thiophenes, can be present. Conventionally, sulfur is removed by absorbing the $H_2S$ gas. Many methods of doing so are known in the art. Among these are the Rectisol unit, trademark of Lurgi Corporation, and the Benfield unit. Alternative methods include absorption using zinc oxide or diglycol-amine solutions.

When using a unit such as the Rectisol (trademark of Lurgi Corporation), most of the sulfur is removed before going to the methanation unit. However, the Rectisol unit is expensive, and alternative sources such as the Benfield unit utilizing hot potassium carbonate or zinc oxide absorbers are most preferred.

In order to maximize sulfur removal using hot potassium carbonate solutions or diglycol-amine solutions, it is also necessary to remove most of the carbon dioxide. Trace quantities of organic sulfur remaining in the synthesis gas are still too high to be acceptable in a methanation reactor, as catalyst deactivation rapidly occurs. Cleanup of the organic sulfur remaining in the synthesis gas is usually accomplished in a hydrodesulfurization reactor where quantities of organic sulfur are converted to hydrogen sulfide by passing over sulfided cobalt molybdenum or nickel molybdenum catalyst. These reactors and reactions are well known to those skilled in this art. An example of such a process is described in the Canadian Journal of Chemical Engineering, Volume 49, pp 605-610, 1971. Hydrogen sulfide and reactants which exit from the hydrodesulfurization reactor are passed through absorbers to remove the hydrogen sulfide.

Conventional carbon dioxide and sulfur removal processes can reduce the sulfur content of the synthesis gas entering the hydrodesulfurization unit below that required to keep the cobalt molybdenum or nickel molydenum catalyst sulfided. When the sulfur content of these catalysts drops below minimum levels, high temperature methanation runaways can occur which endanger the reactor. Injection of hydrogen sulfide ahead of the reactor or periodic resulfiding of the catalyst is a possible solution. However, from an economic viewpoint, the cost of zinc oxide required to absorb the quantity of $H_2S$ required by such a process makes the operation undesirable. It would be of great advantage to provide a method whereby the hydrodesulfurization reactor can be operated at economically low sulfur levels while still providing sufficient protection for both the zinc oxide absorbers and methanation units.

It is therefore an object of the present invention to provide an improved purification process for sulfur removal for coal gas methanation. Other objects will become apparent to those skilled in this art as the description proceeds.

It has now been discovered in accordance with the present invention that removing essentially all carbon dioxide and sulfur from the gaseous stream, then adding carbon dioxide containing much lower sulfur levels back to said stream prior to hydrodesulfurization, will prevent high temperature methanation runaway in hydrodesulfurization reactors. The amount of carbon dioxide necessary to prevent methanation is largely dependent on the catalyst used and the conditions under which the hydrodesulfurization is carried out. Usually at least about 9 or 10 volume percent is necessary. From about 12 to about 25 volume percent $CO_2$ in the stream entering the hydrodesulfurization unit is preferred. Very low concentrations of sulfur in the incoming gas stream allow the cobalt molybdenum or nickel molybdenum catalyst to become desulfided to a sulfur level which, in the prior art, would produce a high temperature methanation runaway. However, it has been discovered that sufficiently high amounts of carbon dioxide present in the incoming gas stream prevent these high temperature methanation runaways. Trace amounts of unremoved organic sulfur, insufficient to keep the catalyst completely sulfided, are then converted by the catalyst to hydrogen sulfide gas, which is then in turn removed by the zinc oxide absorbers before the stream continues to the methanation reactor.

The process of the present invention requires that the hydrodesulfurization catalysts be sulfided; however, the high concentrations of carbon dioxide present greatly lower the amount of sulfur necessary in the catalyst to prevent runaway methanations in the hydrodesulfurization reactor. The minimum amount of sulfur necessary is largely dependent on reaction conditions, such as inlet temperature, space velocity, gas composition, type of catalyst, and the like, but generally .5 parts per million (ppm) sulfur will be sufficient to keep the catalysts sulfided. Of course, lesser amounts are possible by balancing the reaction conditions described above.

The carbon dioxide can be supplied to the incoming process stream either from an outside source or, preferably, is generated internally within the coal gas methanation system. Lurgi Corporation has recommended that carbon dioxide be removed from the synthetic natural gas produced in order to upgrade the BTU quality of the gas. This carbon dioxide is normally vented. However, by simple recycle from the carbon dioxide removal unit to the point prior to entering the hydrodesulfurization reactor, acceptable carbon dioxide levels can be maintained. The carbon dioxide so produced is normally sufficiently free of sulfur for recycle.

The advantages of the process are obvious. A lower cost carbon dioxide and sulfur unit can be used in place of the more expensive methanol absorber (Rectisol process), and the process can be carried out safely. The catalysts need no longer be maintained in a highly sulfided state. Zinc oxide absorbers can be maintained in operable condition at top efficiency for much longer periods of time before replacement since the amount of $H_2S$ which must be absorbed is greatly reduced. The necessary carbon dioxide can be generated (at least in part) internally and recycled without undue cost.

The invention is more concretely described with reference to the examples below wherein all parts and percentages are by volume unless otherwise specified. The examples are intended to be illustrative only and not to limit the present invention.

EXAMPLE 1

A plant test run was carried out. A feed gas from coal gasification was introduced into a hydrodesulfurization reactor containing sulfided nickel molybdenum catalyst at an inlet temperature of 700°F and pressure of 260 pounds per square inch gauge (psig). The outlet temperature rose sharply to 1382°F, necessitating emergency shutdown procedures.

| Feed Gas | Volume Percent | Product Gas Volume Percent |
|---|---|---|
| $H_2$ | 69.2 | not measured |
| $N_2$ | 1.3 | not measured |
| CO | 8.4 | not measured |
| $CH_4$ | 11.0 | not measured |
| $CO_2$ | 5.9 | not measured |
| $C_2H_6$ | .7 | not measured |
| COS | .71* | not measured |
| $CS_2$ | .09* | not measured |
| Thiophene | .13* | not measured |
| $H_2S$ | not measured | not measured |

*Parts per million volume (ppmv).

Product gas was not collected and analyzed due to emergency shutdown.

EXAMPLE 2

The same procedure was followed as described in Example 1 except that a high concentration of $CO_2$ was added back to the feed stream immediately prior to entering the hydrodesulfurization reactor.

| Feed Gas | Volume Percent | Product Gas | Volume Percent |
|---|---|---|---|
| $H_2$ | 63.7 | $H_2$ | 60.5 |
| $N_2$ | 0.2 | $N_2$ | 0.2 |
| CO | 8.7 | CO | 10.1 |
| $CH_4$ | 9.2 | $CH_4$ | 10.6 |
| $CO_2$ | 17.0 | $CO_2$ | 14.2 |
| $C_2H_6$ | 0.6 | $C_2H_6$ | 0.8 |
| COS | .19* | COS | .13* |
| $CS_2$ | —* | $CS_2$ | —* |
| Thiophene | —* | Thiophene | —* |
| $H_2S$ | 200* | $H_2S$ | not measured |

*Parts per million volume (ppmv).

Again, inlet temperature was 700°F and pressure was 260 psig. The outlet temperature was about 700°F and remained about constant, showing that addition of $CO_2$ prevented significant methanation from taking place.

The overall coal gas methanation process can be varied while not affecting the process of the present invention. For example, many such processes use a double methanation reactor in order to completely convert any hydrogen, carbon dioxide, and carbon monoxide which pass through the first stage reactor. These and similar processes do not affect, and will indeed be improved by, the process of the present invention.

While certain embodiments and details have been shown for the purpose of illustrating this invention, it will be apparent to those skilled in this art that various changes and modifications may be made herein without departing from the spirit or the scope of the invention.

We claim:

1. A process for preventing high temperature methanation runaways in a hydrodesulfurization reactor comprising;

a. removing essentially all carbon dioxide and sulfur from coal gas feed streams entering the reactor, the remaining sulfur being insufficient to prevent said high temperature methanation runaways;

b. supplementing the remaining streams with carbon dioxide prior to entering the reactor; and c. maintaining the carbon dioxide level of the stream entering the hydrodesulfurization reactor at a level sufficient to prevent significant methanation based on said sulfur remaining in the feed streams.

2. A process as described in claim 1 wherein the carbon dioxide content of the gasification stream entering the hydrodesulfurization reactor is from about 12 volume percent to about 25 volume percent.

3. A process as described in claim 1 wherein the carbon dioxide is obtained from an internal recycle stream.

4. A process as described in claim 3 wherein the carbon dioxide is obtained from the separation of the exiting synthetic natural gas.

* * * * *